US006073865A

United States Patent [19]

Kriebel et al.

[11] Patent Number: 6,073,865

[45] **Date of Patent: *Jun. 13, 2000**

[54] PROCESS AND DEVICES FOR MANUFACTURING A HOT FRIABLE MATERIAL

[75] Inventors: Almut Kriebel; Volker Niggl, both of Weingarten; Erich Peters, Euskirchen; Josef Schneid, Vogt; Hans Schnell, Mengen, all of Germany

[73] Assignee: Voith Sulzer Papiertechnik Patent GmbH, Ravensburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/046,919

[22] Filed: Mar. 24, 1998

[30] Foreign Application Priority Data

Mar. 26, 1997 [DE] Germany ..... 197 12 651

[51] Int. Cl.[7] ..... B02C 7/02

[52] U.S. Cl. ..... 241/18; 162/23

[58] Field of Search ..... 241/12, 17, 18, 241/20, 21, 23

[56] References Cited

U.S. PATENT DOCUMENTS

| | | | |
|---|---|---|---|
| 1,795,603 | 3/1931 | Hussey . | |
| 3,285,163 | 11/1966 | Burner . | |
| 3,585,924 | 6/1971 | Nolan | 100/43 |
| 3,661,328 | 5/1972 | Leask | 241/18 |
| 3,671,019 | 6/1972 | Tapscott et al. | 259/8 |
| 3,765,611 | 10/1973 | Steiniger | 241/18 |
| 3,847,363 | 11/1974 | Reinhall | 241/245 |
| 3,910,505 | 10/1975 | Reinhall | 241/18 |
| 3,943,034 | 3/1976 | Wallén | 162/232 |
| 4,123,489 | 10/1978 | Kelley | 264/141 |
| 4,136,831 | 1/1979 | Cederquist et al. | 241/18 |
| 4,235,665 | 11/1980 | Reinhall | 162/23 |
| 4,236,959 | 12/1980 | Reinhall | 162/23 |
| 4,283,252 | 8/1981 | Reinhall | 162/23 |
| 5,035,362 | 7/1991 | Mazurkiewicz | 241/1 |

FOREIGN PATENT DOCUMENTS

| | | |
|---|---|---|
| 2224591 | 10/1974 | France . |
| 1806612 | 5/1970 | Germany . |
| 1761864 | 9/1971 | Germany . |
| 2660362 | 6/1980 | Germany . |
| 19523704 | 1/1997 | Germany . |
| 548271 | 10/1942 | United Kingdom . |
| 96/18769 | 6/1996 | WIPO . |

OTHER PUBLICATIONS

Copy of a European Search Report and Annex issued Nov. 28, 1997.

*Primary Examiner*—Joseph J. Hall, III
*Assistant Examiner*—Dermott J. Cooke
*Attorney, Agent, or Firm*—Greenblum & Bernstein, P.L.C.

[57] ABSTRACT

A process is disclosed that is utilized in particular in the preparation of fibrous material of used paper. Hot fibrous pulp friable materials, which are especially suitable for dispersing, are first formed in a compact, high-consistency fibrous material in the form of a plug. In a preferred embodiment, the plug of materials is pushed against a rotor that is equipped with pulverization elements. The pulverization elements remove the fibrous pulp friable materials and distribute them in a disintegrated condition in a processing chamber. In the processing chamber, super-heated vapor is supplied via vapor supply lines, which calefies the fibrous pulp friable materials, for example, by condensation.

23 Claims, 3 Drawing Sheets

PROCESS AND DEVICES FOR MANUFACTURING A HOT FRIABLE MATERIAL

CROSS REFERENCE TO RELATED APPLICATIONS

The present invention claims the priority under 35 U.S.C. §119 of German Patent Application No. 197 12 651.0 filed on Mar. 26, 1997, the disclosure of which is expressly incorporated by reference herein in its entirety.

BACKGROUND OF THE INVENTION

1. Field of the Invention

The invention relates to a process for heating fibrous paper material by providing a compact, high-consistency fibrous paper material, pulverizing the compact material into fibrous pulp friable material, disintegrating the fibrous pulp friable materials, and calefacting the fibrous pulp friable material.

2. Discussion of Background Information

Processes of the kind mentioned above are required, for example, as a preparation for the dispersing procedure of fibrous material, which is extracted from used paper. It is known that the characteristics of fibrous paper material can be significantly improved by dispersing or by a comparable mechanical/thermal treatment. In many cases, a fibrous pulp is used that has a dry content of between 15 and 35% and is brought to a temperature much above the ambient temperature. It is wise to arrange for a calefying, if the fibrous pulp already has the necessary consistency for dispersing. In this thickening process, a considerable part of the water already present in the fibrous pulp is expressed, wherein, first of all, its viscosity increases significantly, and second, less water must be heated. The thickening often proceeds in a worm press.

In a worm press, the fibrous pulp suspension is pressed between a conveyer screw and perforated jacket surrounding the conveyer screw, so that the water escapes through the jacket. The pressed object or plug is pushed out of the worm and breaks up into pieces. The pieces can easily be heated to the targeted temperature, but a relatively long calefaction period is required. By pulverizing these pieces, the calefaction period can be shortened, for example in a tearing worm or in a system with counter-rotating rotors, but that is very expensive.

Prior to the present invention, relatively long periods of calefaction, many minutes, for example, were accepted as a fact, especially when a high temperature over 90° C. was desired.

SUMMARY OF THE INVENTION

According to the present invention, a process is provided which makes it possible to shorten the periods of calefaction, while at the same time reducing the industrial and spatial costs of construction.

The task is accomplished by providing a compact, high-consistency fibrous paper material, pulverizing the compact material into fibrous pulp friable material, disintegrating the fibrous pulp friable materials, and calefacting the fibrous pulp friable material by mixing a gas or vapor-like heat medium therewith, wherein the pulverization, disintegration, and calefaction proceed in a coherent work operation.

By the present process, it is first possible to produce with little expenditure a sufficiently fine friable material, which can be calefied at a correspondingly rapid rate, and second, industrial expenditure is relatively low, measured against the process progress, since the procedures of pulverization and calefaction can be executed in a coherent work step. In advantageous embodiments, the compact paper fibrous material produced from the device is directly loaded into the processing chamber, pulverized there, and calefied immediately thereafter. The calefaction on the surface thereof can begin during the introduction of the compacted fibrous pulp. During the pulverizing process, the pulp is removed from the surface.

In accordance with one embodiment of the present invention, a process for manufacturing a hot friable material containing primarily paper fibers is disclosed that includes providing a compact, high-consistency fibrous paper material, pulverizing the compact material into fibrous pulp friable material, disintegrating the fibrous pulp friable material, and calefacting the fibrous pulp friable material by mixing a gas or vapor-like heat medium therewith, wherein the pulverization, disintegration, and calefaction proceed in a coherent work operation.

The process according to the present invention may further include the fibrous pulp friable materials having a maximal thickness of about 5 mm, the fibrous pulp friable materials having a maximal longitudinal extension of about 30 mm, and the fibrous pulp friable materials being in an eddying condition for most of the period required for calefaction.

Furthermore, in a process in accordance with the present invention, the pulverization, disintegration, and calefaction may occur in the same chamber, and the pulverizing may be carried out by a pulverization device that engages a plug of the high-consistency fibrous paper material emerging from a draining worm. The pulverizing may be carried out by a mechanical device or by a tightly concentrated jet of a gas or a vapor, and the effect of the tightly concentrated jet may be combined with the effect of a mechanical device during pulverizing.

Additionally, in the process according to the present invention, the pulverization, disintegration, and calefaction may occur in a disperser, and a dispersing executed in the disperser may follow.

The present invention is further directed to a device for manufacturing a hot friable material containing primarily paper fibers that includes a processing chamber, at least one moveable pulverization tool adjacent an inlet for the high-consistency material to be processed. The moveable pulverization tool may be provided with scrapers or knives, a vapor feed device is provided in the processing chamber, and a transport device is provided to convey the friable material to an outlet orifice.

Additional features of the device according to the present invention include the moveable pulverization tool including a rotor having pulverization elements, the pulverization elements being disposed on a peripheral surface of rotor or being disposed on a front face of the rotor. The rotor may also include a plurality of paddles on its shaft, which, together with the rotor, can be moved in a peripheral direction. Furthermore, a conveying worm may be disposed substantially parallel to the rotor within the processing chamber, and the conveying worm, in conjunction with the rotor, provides an axial transport of the friable material.

Additionally, the conveying worm may clean the processing chamber, the conveying worm may be disposed above the rotor or adjacent to the rotor, and the rotation speed of the conveying worm may be considerably less than that of the rotor.

An additional feature of the device in accordance with the present invention includes the processing chamber being formed by a rotatable, substantially cylindrical housing in which the rotor is located, and the outer periphery of the rotor is spaced a distance from the lower inner side of the housing of no greater than about 10 mm at the most.

The present invention is further directed to a device for manufacturing a hot friable material from a compact, high consistency fibrous pulp friable material, the device including a processing chamber located between a stator and a rotor of a disperser mounting, the rotor being provided with pulverizing elements in a pulverizing zone, wherein a plug exiting from a draining press is first transported into the pulverizing zone and is pushed against the pulverizing elements of the rotor. A ring-shaped vapor chamber is formed downstream of the pulverizing zone, and the ring-shaped vapor chamber is supplied with super-heated vapor via vapor supply lines to provide calefaction of the friable material formed in the pulverizing zone. The actual disperser zone of the disperser mounting extends radially farther outwardly of the ring-shaped vapor chamber. Furthermore, the disperser zone may also include a plurality of rows of teeth, which can be moved relative to one another at a radial distance no greater than about 3 mm.

While designing the mechanisms used in the pulverization operation, the prior art can be referred to. It is possible to use rotors bearing pulverizing tools, which are pushed against plugs of the material to be pulverized, whereby, as a general rule, the plugs provide sufficient support. It is, therefore, an advantage that a second fixed working tool is unnecessary.

Execution of the named process with a compact unit, can be more efficiently attained if the high-consistency fibrous paper material can be fed directly into the disperser. The material is then, as seen in the flow direction, taken up by the first pulverizing stage of the disperser and is pulverized and eddied, wherein the friable materials arise. By feeding vapor into the zone in the first pulverizing stage that follows downstream, the material is then calefied to the necessary temperature, whereby, due to the good pulverizing effect, a relatively short calefaction period is sufficient. The actual dispersing, that is, the altering of the material characteristics, proceeds in the disperser zone, which follows downstream.

Further embodiments and advantages can be seen from the detailed description of the present invention and the accompanying figures.

BRIEF DESCRIPTION OF THE DRAWINGS

The present invention is further described in the detailed description which follows, by reference to the noted plurality of drawings by way of non-limiting examples of preferred embodiments of the present invention, in which like reference numerals represent similar parts throughout the several views of the drawings, and wherein.

DETAILED DESCRIPTION OF THE EMBODIMENTS

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
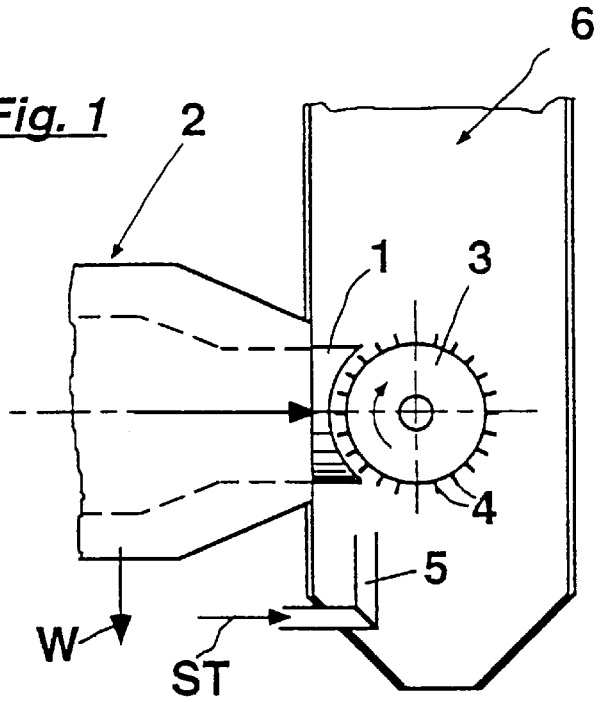
FIG. 1 depicts a device for executing the general process of the present invention.

The depiction in FIG. 1 shows, with simplified technical characteristics, in which manner the process in accordance with the invention can generally proceed. It can be recognized that a high-consistency fibrous paper material, in the form of a plug 1, is emitted from a thickening press 2 and driven into the processing chamber 6. This plug has, for example, a consistency of between about 15% and about 20%, and, thus, has a certain stability. Depending on the operating conditions which prevail in the thickening press 2, the material can already have a temperature that lies above the ambient level, for example, between about 30° C. and about 40° C. For simplicity's sake, the plug 1 is depicted in all figures in a circular cylindrical manner, but it can also have other cross-sectional shapes. For example, it can exit the thickening press 2 in an annular shape. The pulverizing step is executed by a rotor 3, against which the plug 1 is pressed, which removes the fibrous pulp friable material at the point of contact. Through the motion of the rotor, as well as through superheated vapor ST that is supplied via a vapor line 5, a strong swirling and mixing with the vapor takes place. The friable material is thus calefied very quickly and thereafter can leave the processing chamber 6 for further treatment, for example, dispersing.

Figure 2:
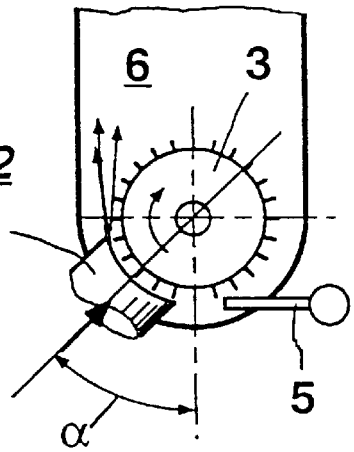
FIGS. 2 and 3 each shows a variation of the device for executing the process of the present invention.

Consequently, the pulverization, the swirling, and the calefying of the fibrous paper material occur in a coherent work step. In order to guarantee the most uniform and economical calefying possible, the duration of the fibrous material in the processing chamber 6 must be defined as clearly as possible. Expressed another way, the transport procedure must be carefully controlled. To this end, if an even vortex base forms, the mean duration can be determined from through-put and volume of the processing chamber 6. In other cases, as for example shown in FIG. 2, an additional conveyer device 9 is provided which defines the period of contact of the fibrous paper material with the super-heated vapor. FIG. 2 further shows that the supply of the superheated vapor ST can be introduced in the direct vicinity of the pulverizing zone, through which the vapor penetrates the material more quickly, which also accelerates the calefying. If the vapor jet is correspondingly tightly concentrated, then, under certain conditions, it can aid with the stripping of the material from the plug up to the point of its condensation. The processing chamber is not depicted in FIG. 2. However, the processing chamber is shown schematically in FIG. 3 by the supply worm 8 and the subsequent downstream disperser 7.

The supply of the fibrous paper material can advantageously proceed over an angle $\alpha$ of approximately 45° with respect to the perpendiculars, as shown in FIG. 2. Thus, an optimal trajectory of the friable material in the upper region of the processing chamber 6 arises.

Figure 3:
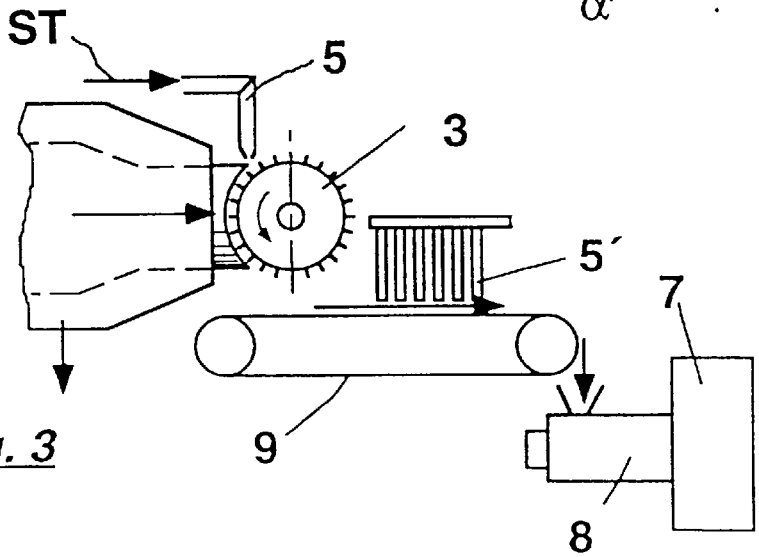
Figure 4:
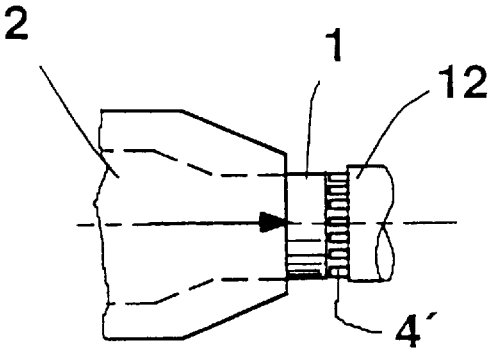
FIG. 4 shows a further variation of the device for executing the process of the present invention with a modified pulverizing tool.

Whereas the rotors 3 have pulverization elements 4 on their periphery in FIGS. 1, 2, and 3, the rotors can also be fixed on the face of a modified rotor, as shown in FIG. 4. In this event, paddles 10, for example, can be mounted on the shaft of the rotor to eddy the friable material.

Figure 5:
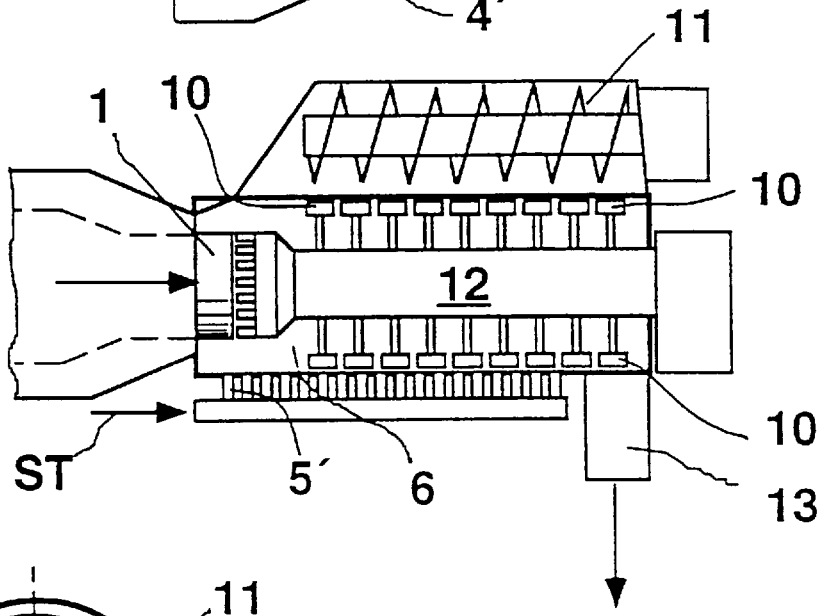
FIGS. 5–7 show further advantageous devices for executing the process of the present invention.

In FIGS. 4 and 5, a type of pulverization tool is shown that has pulverizing elements 4' provided on the face, and paddles provided on the rotor shaft 12. The fibrous pulp that is peeled off is taken up the paddles 10 that are fastened to the same rotor 12. They are whirled in a peripheral direction, and hurled into the region above the rotor 12. At the same time, the superheated vapor enters the processing chamber 6 from below via a plurality of vapor lines 5'. Since in this case the paddles essentially create a circumferential movement, the axial speed can be regulated separately, in that, for example a separate conveying worm is mounted above the effective range of the rotor 12, which, first, provides for the axial thrust, and, second, prevents the adhesion of fibrous material in the upper part of the processing chamber 6. In some cases, problems arise due to the fact that the friable material, which eddies around in the processing chamber 6, sticks and dries to the walls forming the processing chamber. It is thus advantageous if the eddying is so intense that all of the material reaches the area of the conveying worm 11 and returns to the region of the rotor many times, through which its duration is extended. After the processing, the material falls through the outlet orifice 13, where a sluice gate may be provided.

Figure 6:
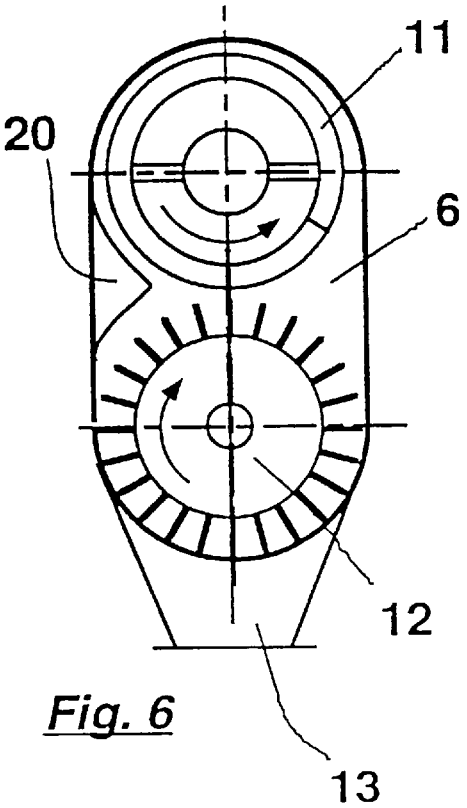

FIG. 6 shows a different view of the process described above, the eddying of the friable material by rotor 12 displaced below and axial conveying by a conveying worm 11 displaced above. The advantage of such an arrangement is, as stated previously, the ability to use a rotor, in this case disposed below, to eddy the fine friable material, so that it can very easily come into contact with the superheated vapor. Thus, the friable material may, preferably several times, reach the part of the processing chamber disposed above in which the separate, and therewith differently adjustable, conveying worm 11 rotates. Advantageously, this can be a belt worm, the conveying belt, along with the rotor 12 as shown in FIG. 6, of which keeps the housing free of baked-on material. In place of the paddles, the rotor 12 can also contain a further conveying worm enmeshed with the conveying worm 11. In order to control the trajectory of the friable materials, guide devices 20, which are not discussed in detail, can be present.

Figure 7:
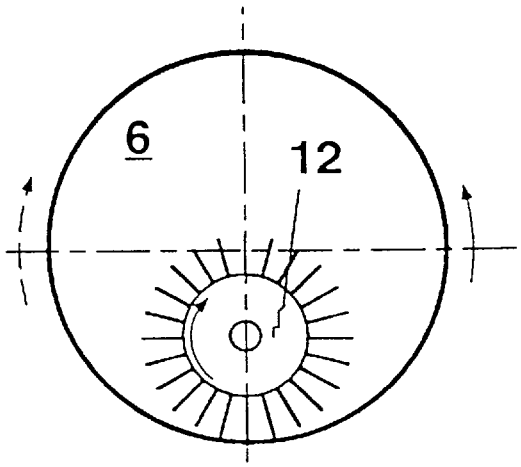

The adhering or attachment of hot friable material can be prevented by an arrangement that is illustrated in FIG. 7. In accordance with this embodiment, the rotor 12 is eccentrically arranged in an essentially cylindrical or conically-shaped housing, which delimits the processing chamber. If this housing is put into a slow rotational movement, then friable material which might adhere to the housing wall, reaches the paddle region of the rotor in a cyclical manner due to the rotation, and, at that time, is scraped off. In such an arrangement, the axial transport of the friable material within the processing chamber can be guaranteed through diagonal positioning or a conical contour of the housing.

These illustrations only show the operating principles, without disclosing the construction details of the machine, which are known to those skilled in the art. In addition, the vapor supply lines are not shown in FIGS. 4, 6, and 7.

Figure 8:
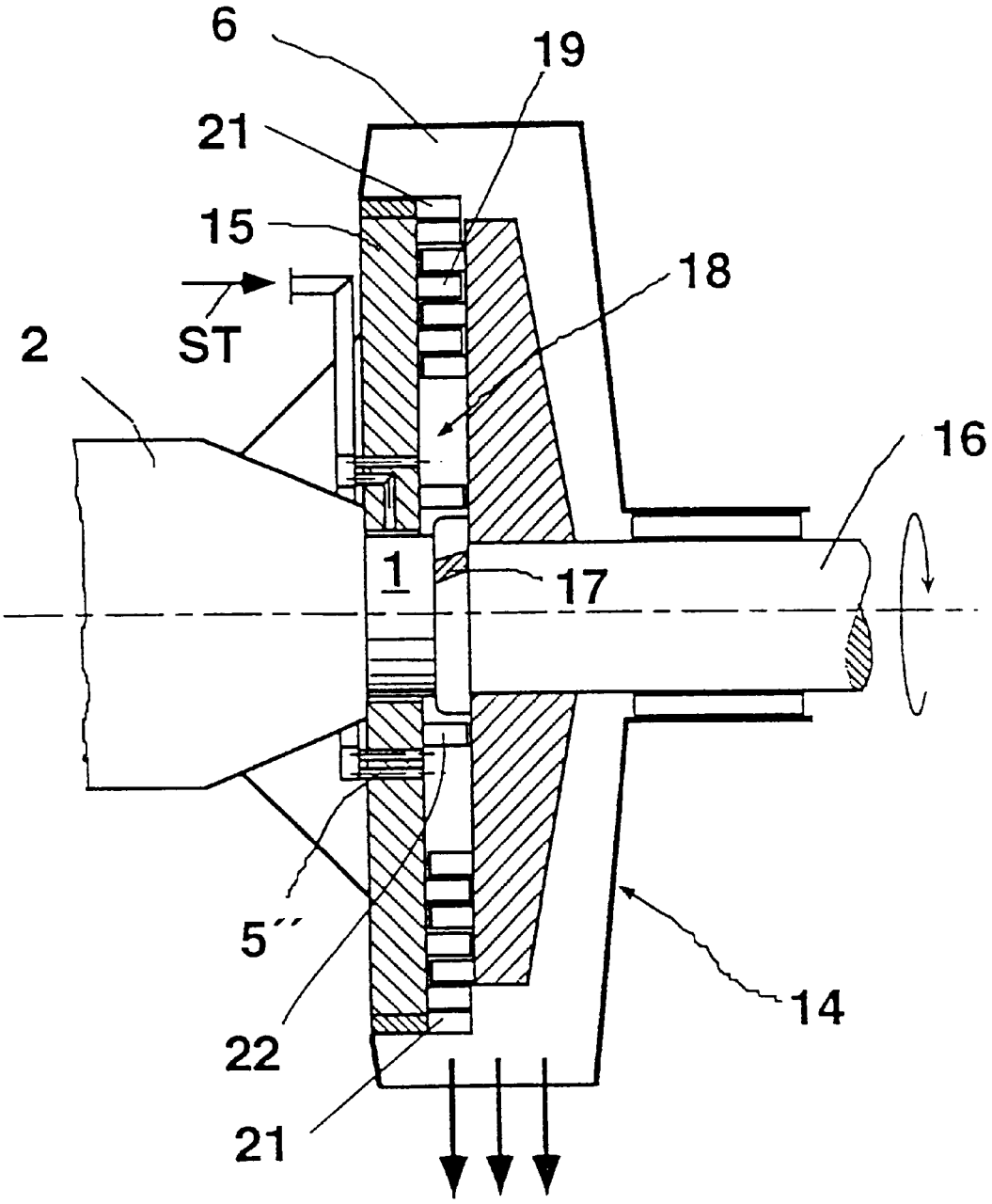
FIG. 8 shows an advantageous combination of a device for executing the process of the present invention with a dispersing directly thereafter.

FIG. 8 shows a preferred embodiment of the process in accordance with the invention with the aid of a device which can be used for it. In accordance with this embodiment, the high-consistency fibrous paper material, exiting the thickening press 2 as a plug 1, is pushed directly into the region of a disperser garniture. In the embodiment shown here, the device includes a disperser mounting having a radial pulp flow, including a stator 15 and a rotor 16. Generally, an axial disperser or a kneader can also be used. The disperser 14 shown here is loaded radially inwardly, and a first pulverizing element 17 is mounted in the center of the rotor 16, which can have, for example, wing-shaped or cross-shaped pulverization strips. The plug 1 is pressed against the first pulverizing element, as described in previous embodiments, is scraped off or rasped off, and, in the process, is distributed in small pieces. Primary stator teeth 22 retard the material and thus increase its duration in the vapor chamber 18 that follows radially outside. The vapor chamber 18 is essentially ring-shaped and contains none of the teeth that provide the mechanical dispersing.

In a known manner, the dispersing is effected, in that the teeth of the disperser are moved past one another at a relatively high speed while being very close to each other, and the fibrous pulp which is between them is subjected to very high shearing forces. This function, in a device for effecting the process in accordance with the invention, is first provided by the disperser zone 19 that follows radially outwardly of the vapor chamber 18. The pulp is thus not mechanically dispersed within the vapor chamber. If necessary, installations can be provided which retard or eddy the movement of the pulp. Supplied superheated vapor ST is brought into contact with the pulp via the vapor supply lines 5". In the vapor chamber 18, the pulp is thereby eddied or at least kept disintegrated, so that it can be effectively penetrated by the vapor.

Here, too, the calefying is essentially attained by the condensation of the vapor, that is, the vapor is constantly resupplied. The resupplying improves the eddying and the loosening up of the fibrous pulp friable materials. The vapor chamber 18 can be easily sealed off from the outside by the plug 1 and the pulp in the disperser zone 19. Closing off of the disperser zone 19 by a choking ring 21 is also advantageous, since the through-put and the fill-level can also be controlled in this manner. In conjunction with the invention, a high and even fill-level in the disperser zone 19 is particularly advantageous, since otherwise the exterior diameter of the disperser mounting would have to be designed to be very large, in order to transfer the targeted specific work. A choking ring of this kind is, for example, known from DE 195 23 703 A1.

In sum, the execution of a process in accordance with FIG. 8 results in a high effectiveness for the smallest space, which makes very compact devices possible. The size of the vapor chamber 18 must, therefore, be designed such that the friable material found therein has the necessary duration of stay for calefying. According to size, about 1 to about 2 seconds are required, the time depending on the desired temperature and on the size of the friable material.

Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A process for manufacturing a hot friable material containing primarily paper fibers, comprising:

providing a plug of compact, high-consistency fibrous paper material;

pulverizing said compact material, at an end face of said plug, into fibrous pulp friable material;

dispersing said fibrous pulp friable material; and calefacting said fibrous pulp friable material by injecting and mixing a gas or vapor heat medium therewith at a location downstream of said end face of said plug to heat the fibrous pulp friable material subsequent to providing said plug and simultaneously with said pulverizing and said dispersing such that the pulverization and calefaction proceed in a coherent work operation.

2. A process in accordance with claim 1, wherein said fibrous pulp friable materials have a maximal thickness of about 5 mm.

3. A process in accordance with claim 1, wherein said fibrous pulp friable materials have a maximal longitudinal extension of about 30 mm.

4. A process in accordance with claim 1, further comprising eddying said fibrous pulp friable materials for most of the period required for calefaction.

5. A process in accordance with claim 1, wherein the pulverization, dispersing, and calefaction occur in the same chamber.

6. A process in accordance with claim 1, wherein said pulverizing is carried out by a pulverization device that engages a plug of said high-consistency fibrous paper material emerging from a draining press.

7. A process in accordance with claim 1, wherein said pulverizing is carried out by a mechanical device.

8. A process in accordance with claim 1, wherein said pulverizing is carried out by a tightly concentrated jet of a gas or a vapor.

9. A process in accordance with claim 8, wherein the effect of the tightly concentrated jet is combined with the effect of a mechanical device during said pulverizing.

10. A process in accordance with claim 7, wherein pulverization, dispersing, and calefaction occur in a disperser.

11. A device for manufacturing a hot friable material containing primarily paper fibers comprising:

a device for providing a plug of high-consistency material to be processed;

a processing chamber, including at least one moveable pulverization tool adjacent an inlet for the plug of high-consistency material to be processed, said moveable pulverization tool being provided with scrapers or knives configured to engage an end face of the plug, said processing chamber including at least one dispersing device having dispersing elements discrete from said scrapers or knives of said pulverization tool;

a vapor feed device in said processing chamber; and a transport device to convey the friable material to an outlet orifice.

12. A device in accordance with claim 11, wherein said moveable pulverization tool comprises a rotor having pulverization elements.

13. A device in accordance with claim 12, wherein said pulverization elements are disposed on a peripheral surface of said rotor.

14. A device in accordance with claim 12, wherein said pulverization elements are disposed on a front face of said rotor.

15. A device in accordance with claim 14, wherein said rotor includes a plurality of paddles on its shaft forming said at least one dispersing device, which, together with said rotor, can be moved in a peripheral direction.

16. A device in accordance with claim 15, wherein a conveying worm is disposed substantially parallel to said rotor within said processing chamber, and said conveying worm, in conjunction with said rotor, provides an axial transport of the friable material.

17. A device in accordance with claim 16, wherein said conveying worm cleans said processing chamber.

18. A device in accordance with claim 16, wherein said conveying worm is disposed above said rotor.

19. A device in accordance with claim 16, wherein said conveying worm is disposed adjacent to said rotor.

20. A device in accordance with claim 16, wherein the rotation speed of said conveying worm is less than that of said rotor.

21. A device in accordance with claim 11, wherein said processing chamber is formed by a rotatable, substantially cylindrical housing in which said rotor is located, and the outer periphery of said rotor is spaced a distance from the lower inner side of the housing of no greater than about 10 mm at the most.

22. A device for manufacturing a hot friable material from a compact, high consistency fibrous pulp friable material, comprising:

a draining press for providing a plug of compact, high consistency fibrous pulp friable material;

a processing chamber located between a stator and a rotor of a disperser mounting, said rotor being provided with pulverizing elements in a pulverizing zone and dispersing elements in a discrete dispersing zone, wherein the plug exiting from said draining press is first transported into said pulverizing zone and an end face thereof is pushed against said pulverizing elements of said rotor;

a ring-shaped vapor chamber formed downstream of said pulverizing zone, said ring-shaped vapor chamber being supplied with super-heated vapor via vapor supply lines to provide calefaction of the friable material formed in said pulverizing zone, and wherein said discrete disperser zone of the disperser mounting extends radially farther outwardly of said ring-shaped vapor chamber.

23. A device in accordance with claim 22, wherein said dispersing elements in said disperser zone include a plurality of rows of teeth formed respectively on said stator and said rotor, which can be moved relative to one another at a radial distance no greater than about 3 mm.

* * * * *